US007556508B2

(12) United States Patent
Schlumpf

(10) Patent No.: US 7,556,508 B2
(45) Date of Patent: Jul. 7, 2009

(54) MULTI-POLE PLUG UNIT

(76) Inventor: Peter Schlumpf, Grabenackerstrasse 4, Ellikon an der Thur (CH) 8548

( * ) Notice: Subject to any disclaimer, the term of this patent is extended or adjusted under 35 U.S.C. 154(b) by 0 days.

(21) Appl. No.: 12/158,036

(22) PCT Filed: Oct. 23, 2006

(86) PCT No.: PCT/CH2006/000588

§ 371 (c)(1),
(2), (4) Date: Jun. 18, 2008

(87) PCT Pub. No.: WO2007/071078

PCT Pub. Date: Jun. 28, 2007

(65) Prior Publication Data

US 2008/0299815 A1 Dec. 4, 2008

(30) Foreign Application Priority Data

Dec. 21, 2005 (CH) ..... 2031/05

(51) Int. Cl.
*H01R 12/00* (2006.01)

(52) U.S. Cl. ..... 439/76.1; 439/372; 439/24

(58) Field of Classification Search ..... 439/76.1, 439/372, 6–24, 677–680
See application file for complete search history.

(56) References Cited

U.S. PATENT DOCUMENTS

| | | | | | |
|---|---|---|---|---|---|
| 4,590,337 | A * | 5/1986 | Engelmore | 439/21 |
| RE32,805 | E * | 12/1988 | Engelmore et al. | 439/26 |
| 4,813,892 | A * | 3/1989 | Strate | 439/680 |
| 5,809,136 | A * | 9/1998 | Turner | 439/24 |
| 6,764,347 | B1 * | 7/2004 | Plishner | 439/668 |
| 7,101,187 | B1 * | 9/2006 | Deconinck et al. | 439/22 |

* cited by examiner

*Primary Examiner*—Briggitte R Hammond
(74) *Attorney, Agent, or Firm*—Janet Sleath; Speckman Law Group PLLC

(57) ABSTRACT

The invention relates to a multi-pole plug unit comprising a plug and a socket. The plug has a polygonal cross section, a longitudinal groove running in the region of a longitudinal edge, which longitudinal groove is crossed by a large number of transverse grooves with a predetermined grid pattern. A printed circuit board is inserted in the longitudinal groove, which printed circuit board has contact pads at certain points of the transverse grooves. The socket has contact wires or pins, which run transversely with respect to the longitudinal directions, to come to lie in the transverse grooves owing to the rotation of the plug and therefore come into touching contact with the contact faces and, at the same time, bring about translatory locking of the plug in the socket.

12 Claims, 4 Drawing Sheets

MULTI-POLE PLUG UNIT

REFERENCE TO RELATED APPLICATIONS

This application is the US national phase entry of International Patent Application No. PCT/CH2006/000588, filed Oct. 23, 2006, which claims priority to Swiss Patent Application No. 2031/05, filed Dec. 21, 2005.

FIELD OF THE INVENTION

The invention relates to a multi-pole plug unit comprising a plug with a non-conducting plug body and a corresponding socket, which when combined form an electrical and a positive-locking connection.

BACKGROUND OF THE INVENTION

There are different types of multi-pole plug units in existence that are suitable for transporting different electrical signals, for example multi-plug systems. Such a multi-pole plug unit comprises a plug comprising multiple pins, and a connector socket, which has a corresponding socket for each pin. Such a plug unit has the disadvantage that not all electrical contacts are made at the same time and that incorrect manipulation during use can interrupt a portion of the contacts. Such plug units are not suitable for example for devices which use different electrical signals to perform different measurements simultaneously. The measurements from the first moments following connection are unusable if the electrical contacts are not closed simultaneously.

An example of such a device is a multifunctional catheter probe, which the applicant has developed and disclosed in patent application CH 1646/04. This multifunctional catheter probe has a multi-luminar tube, which is divided into different sections. The consecutive sections are joined together via a coupling piece. This coupling piece enables both the connection of each lumen of a tube section to each lumen of a following tube section, and also carries a sensor. The electrical cables of the sensors each extend each in a lumen from the coupling piece to the end of the multi-luminar tube. Multiple electrical cables emerge from the end of the multi-luminar tube. A plug unit is thus necessary in order to supply all sensors via these electrical cables and to convey their various signals to a central analysis unit.

While the construction of such medical devices is becoming ever smaller and the central analysis units ever more compact, all the plug units available on the market up to now are comparatively large. The more connections need to be made, the more difficult it is to join the contacts together without causing misconnections or bending of pins.

An essential problem to be avoided in this process is that when joining plug and socket together no transient contact connections must be allowed to occur which do not correspond to any of the selected contact combinations. In plug units in which the contacts are positioned successively in the direction of motion of the insertion of the plug however, this is problematic.

SUMMARY OF THE INVENTION

The problem addressed by the invention is to create a multi-pole plug unit which when connected, creates all electrical contacts simultaneously and which allows a particularly compact construction with a high density of contacts per unit volume, which also virtually excludes incorrect manipulation.

This problem is solved by a multi-pole plug unit comprising a plug (2) with a non-conducting plug body (4) and a socket (3) with a socket housing (20) comprising an insertion opening (22), which when combined form an electrical and a positive-locking connection, characterized in that the plug body (4) has a polygonal cross-section, wherein in the region of at least one longitudinal edge (18) there extends a longitudinal groove (12) which is crossed by a plurality of transverse grooves (14) in a pre-defined grid pattern, and that in the longitudinal groove (12) a printed circuit board (6) is inserted, which at certain points of the transverse grooves has contact surfaces (8), and that additionally the socket (3) has contact wires or pins extending transversely to its longitudinal direction (28), which by rotation of the plug (2) come to lie in the transverse grooves (14) and thus come into touching contact with the contact surfaces (8) and simultaneously effect a translatory locking of the plug (2) in the socket (3).

In one embodiment, the longitudinal groove (12) is opened along at least one part of its length, and the printed circuit board (6) is inserted in this open longitudinal groove (12) and is held in place by being glued or clamped in. In another embodiment, the longitudinal groove is closed and of a tunnel-shaped construction and is arranged in the plug body in the longitudinal direction, wherein the longitudinal groove discharges into an opening at the end of the plug body, the printed circuit board (6) is introduced into the longitudinal groove and wherein the longitudinal groove crosses the transverse grooves (14). The longitudinal groove (12) may be expanded in the region of the groove base and the circuit board (6) held in this region with a positive-locking fit. In a further embodiment, the plug body (4) has a cavity extending in its longitudinal direction, which is joined via feed-through channels (41.1, 41.2, 41.3, 41.4, 41.5) extending transversely to the longitudinal direction to the longitudinal grooves, wherein lead wires leading to the circuit board are arranged in the feed-through channels. The plug body (4) may alternatively have a circular cross-section in the region of the transverse grooves (14). In certain embodiments, the insertion opening defines a passage for the plug body (4) having a polygonal shape corresponding to the cross-section of the plug body (4). In this embodiment, at least one stop piece (36.1, 36.2, 36.3, 36.4) is moulded on the socket housing (20) in the region of the insertion opening (22). The at least one stop piece guarantees a predefined angular position of the plug body (4) to the contact wires or pins (28) of the socket (3) during the insertion of the plug. In yet another embodiment, a cam (32) is moulded on a side surface of the polygonal cross-section plug body (4), which cam can be inserted in a corresponding receiving channel (34) in the socket housing (20) with a positive-locking connection. The receiving channel (34) may be connected to a circular groove, in which the cam (32) is able to engage in an end position, whereby the plug is securable in the socket body with a bayonet-type closure. Alternatively, a cam is applied in the socket housing (20), which projects into the insertion opening (22), and fits into a longitudinal groove in the plug body (4) with a positive-locking connection. In yet a further embodiment, the socket housing (20) has a rectangular cross-section and all of the contact wires or pins (28) are brought out on one side surface of the socket housing, so that the socket housing can be applied to a circuit board of a printed circuit. The precise configuration and the operation of the subject matter of the invention is explained in the following description with reference to the attached drawings. In the drawings a preferred exemplary embodiment of the subject matter of the invention is illustrated.

BRIEF DESCRIPTION OF THE DRAWINGS

The invention will now be described in combination with the drawings. Shown are.

DETAILED DESCRIPTION

Figure 1:
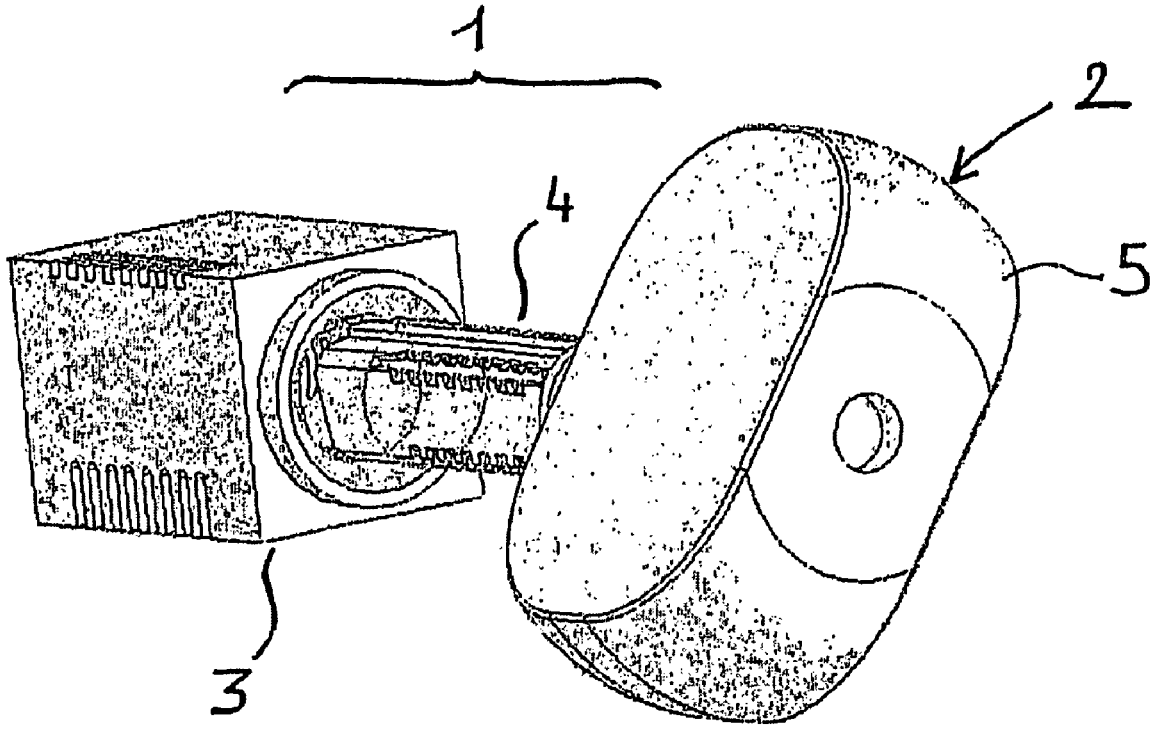
FIG. 1 a perspective view of a first variant of the multi-pole plug unit according to the invention.

FIG. 1 shows a first variant of a plug unit according to the invention. The multi-pole plug unit 1 comprises a plug 2 and a socket 3. The plug 2 has a plug handle 5 and a non-conducting plug body 4. According to the invention the non-conducting plug body 4 is inserted into the socket 3 and rotated with the plug handle 5, in order to enable the electrical contacts simultaneously. The plug 2 is further described in FIGS. 2 to 6.

Figure 2:
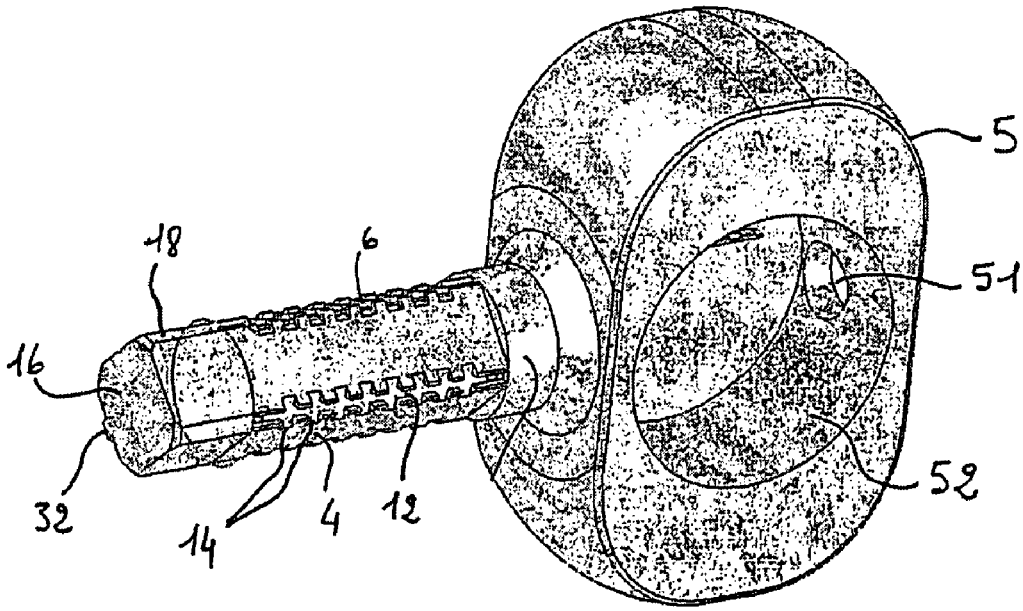
FIG. 2 a perspective view of the plug according to the invention.

The plug handle 5 is joined to the plug body 4. As an example, in FIG. 3 the plug handle 5 has an entry hole 51, which represents an access to an inner chamber 52. The plug body 4 comprises a cavity extending in its longitudinal direction which discharges into the inner chamber 52. The inner chamber 52 and the entry hole 51 define an access from the outside into the cavity 42, the function of which will be explained later. The non-conducting plug body 4 is an oblong body, having a polygonal cross-section, for example a square cross-section 16 as shown in FIG. 2. The polygonal cross-section can also be a triangular, pentagonal, hexagonal, octagonal, etc. cross-section. The longitudinal edges 18 of this plug body 4 can be rounded. According to the invention, a longitudinal groove 12 extends in the region of at least one longitudinal edge 18 of the plug body 4.

Figure 5:
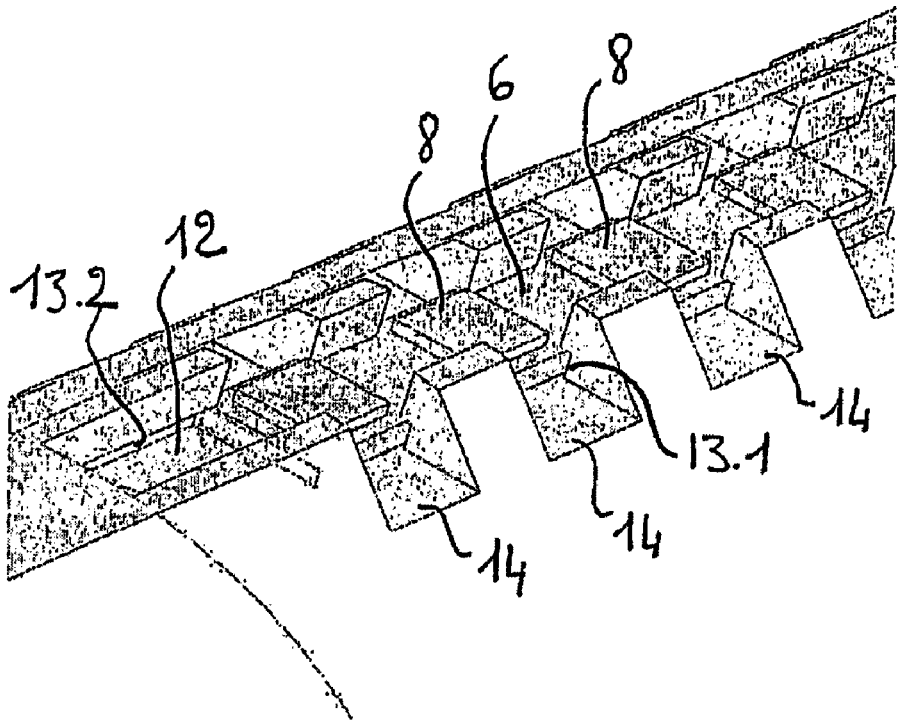
FIG. 5 a detail D of the plug according to FIG. 4.

In FIG. 2 one longitudinal groove 12 extends in the region of each longitudinal edge 18 of the oblong plug body 4. Each longitudinal groove 12 is crossed by a plurality of transverse grooves 14 in a grid pattern. These transverse grooves 14 extend parallel and distributed alongside one another, at regular intervals, over the longitudinal groove 12. As shown in FIG. 5, in the longitudinal groove 12 there is a printed circuit board 6 with contact surfaces 8 inserted in such a way that certain contact surfaces correspond to predefined points of the transverse grooves 14. The transverse grooves 14 form an access to the contact surfaces for contact wires or contact pins of the socket 3 extending transversely to the longitudinal direction, as is described later with the aid of FIGS. 7 and 8. When the plug body 4 is inserted into the socket 3, the contact surfaces do not come into touching contact with the contact wires or contact pins of the socket 3. The contact wires or contact pins are arranged in such a way that by rotation of the plug they come to lie in the transverse grooves, and thus come into touching contact with the contact surfaces and simultaneously bring about a translatory locking of the plug in the socket. The longitudinal groove 12 of the plug is described in detail in the following.

Figure 3:
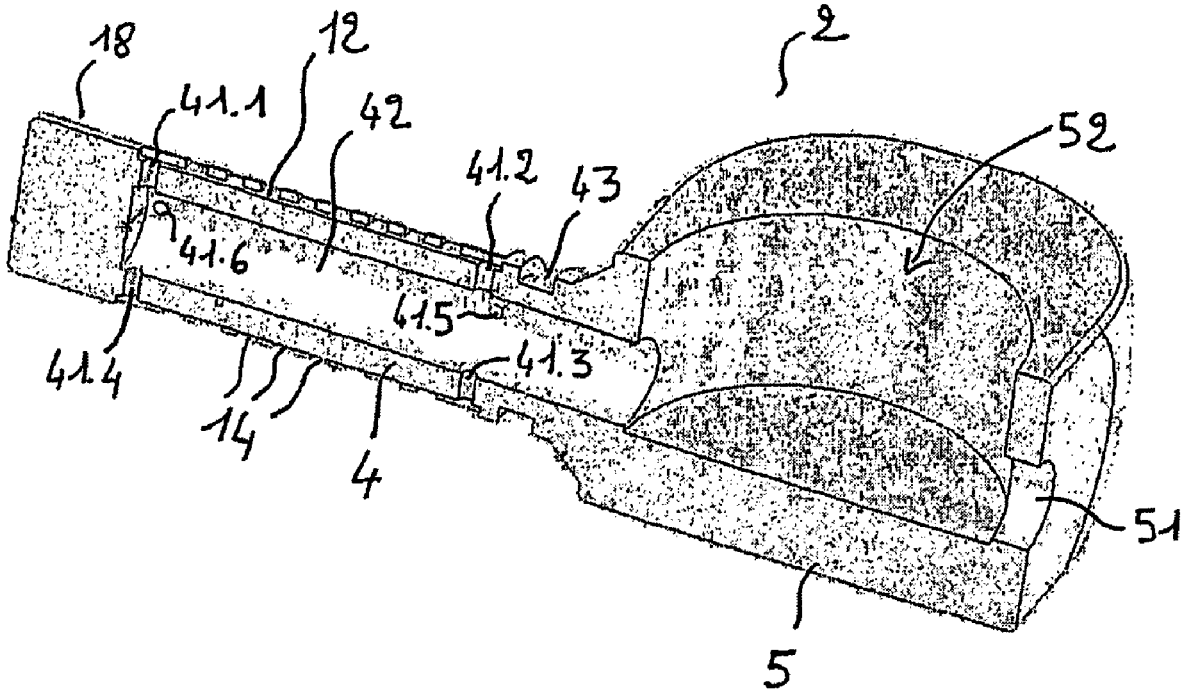
FIG. 3 an axial section through a plug according to a first variant of the invention.
Figure 4:
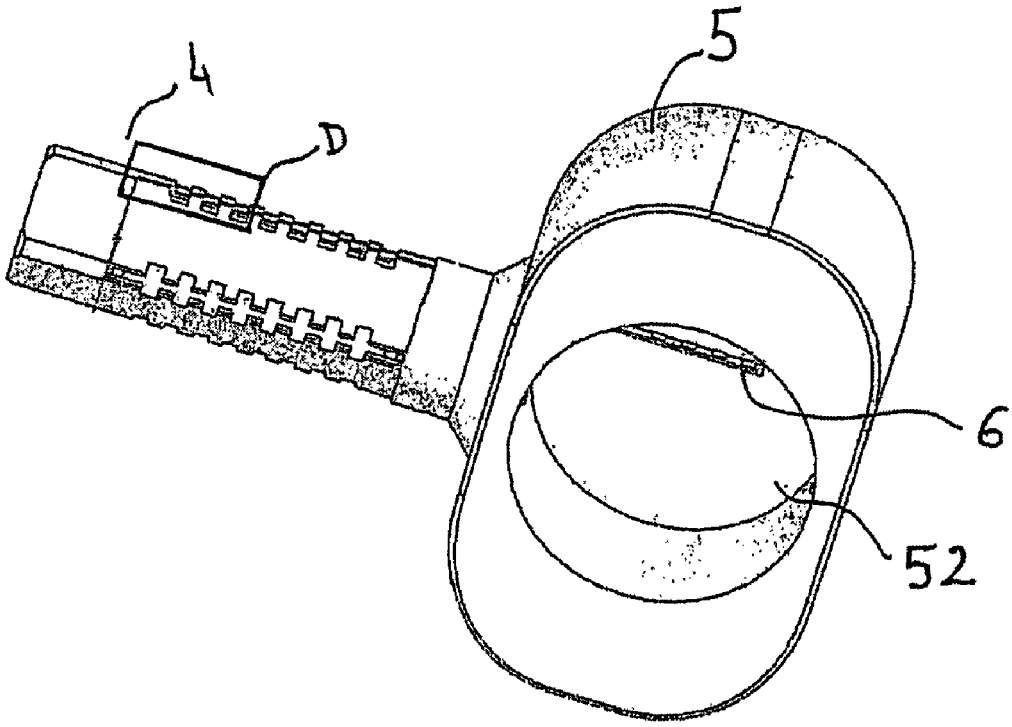
FIG. 4 a perspective view of the plug according to a second variant of the invention.

The longitudinal groove 12 can be either a closed or open longitudinal groove. In FIGS. 3 and 5 an open longitudinal groove 12 is shown. The term open longitudinal groove 12 is used where in the region of a longitudinal edge 18, a longitudinal groove is opened along at least one part of its length. This externally directed opening in the plug body 4 enables a printed circuit board with contact surfaces to be inserted, glued or clamped into the longitudinal groove 12. FIG. 5 shows another embodiment of an open longitudinal groove, which is expanded in the region of the groove base. The open longitudinal groove 12 comprises two laterally engaging longitudinal channels 13.1 and 13.2, so that the cross-section of the open longitudinal groove 12 forms a cross-section in the shape of a rotated T. A first example is shown in FIG. 4. This open longitudinal groove 12 discharges into the inner chamber 52 of the plug handle 5 and a printed circuit board 6 can be inserted into the open longitudinal groove through this opening into the inner chamber 52. The lateral longitudinal channels 13.1 and 13.2 hold both longitudinal sides of the circuit board 6 rigidly in the open longitudinal groove 12. Instead of discharging into the inner chamber, the open longitudinal groove can also emerge at the other end of the plug body 4. It is also possible to have an open longitudinal groove 12 with two lateral longitudinal channels 13.1 and 13.2 with or without an opening at one end of the plug body. In this case a flexible printed circuit board 6, for example a flexi-print, with contact surfaces 8, is inserted in the longitudinal groove 12 under pressure until this snaps in, so that each longitudinal side of this circuit board 6 engages in a lateral longitudinal channel 13.1, 13.2 so that the circuit board 6 is rigidly held in the plug body 4 by a positive-locking or force connection.

Another variant, not illustrated, consists of a closed or covered longitudinal groove 12. In the region of a longitudinal edge 18 a longitudinal groove closed over its entire length is moulded in the plug body 4, which groove has an opening on at least one of its two ends, into which a printed circuit board 6 can be inserted. The opening of the covered longitudinal groove, as already explained for an open longitudinal groove, can either discharge into the end of the plug body that is inserted into the socket, or can discharge into the other end of the plug body, which discharges for example into the inner chamber 52. The tunnel-shaped closed longitudinal groove however crosses all of the transverse grooves 14 in such a way that the contact surfaces of the circuit board can be located at these points.

A circuit board 6 comprises multiple contact surfaces 8, which are connected to lead wires that are not shown, so that each contact surface 8 has an electrical supply. For this purpose the cavity 42 comprises feed-through channels 41.1, 41.2, 41.3, 41.4, 41.5, transversely to the longitudinal direction, which discharge into the various longitudinal grooves 12. The lead wires not shown extend from the circuit boards 6 inserted in the longitudinal grooves in the feed-through channels 41.1, 41.2, 41.3, 41.4, 41.5, then into the cavity, cross the inner chamber 52, to finally discharge into the entry hole.

Figure 7:
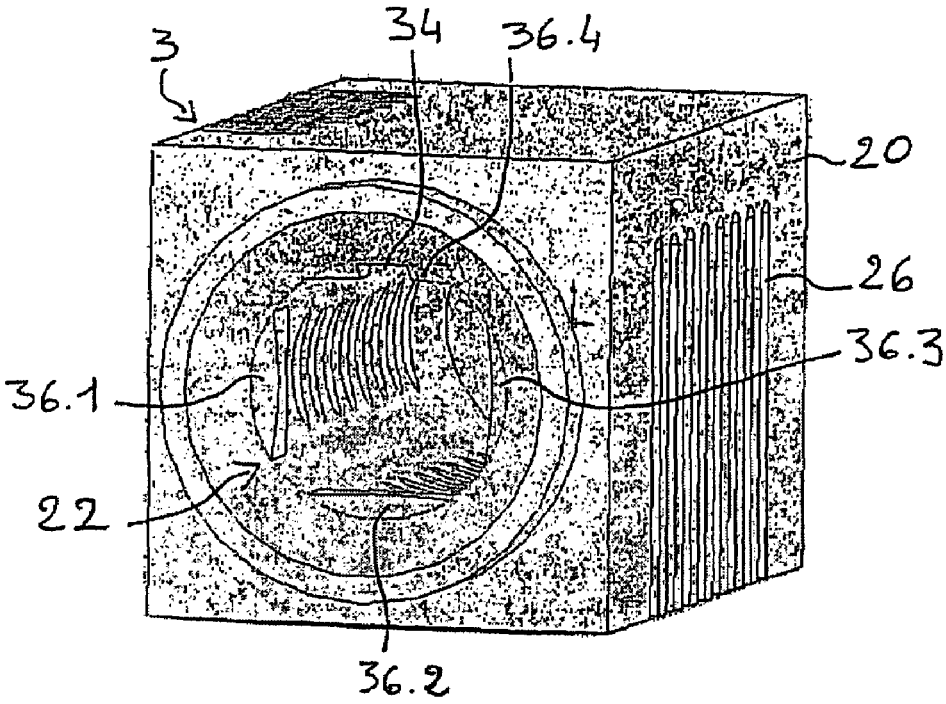
FIG. 7 a perspective view of the socket according to FIG. 1.

The socket 3 corresponding to the described plug 2 is now described with reference to FIGS. 7 and 8. The socket comprises a socket housing 20, which has an inner chamber 24 for receiving the plug 2. This inner chamber 24 is cylindrical and has a circular cross-section, such that the polygonal cross-section of the plug body 4 can be inserted in the circular cross-section. Through holes 26 extend transversely to the longitudinal direction in the socket housing 20 and form a row in the longitudinal direction with the grid pattern of the transverse grooves of the plug. In the wall of the inner chamber 24 multiple rows of through holes are formed, which are arranged in such a way that every row corresponds to a longitudinal edge of the plug body. Contact pins or contact wires 28 extend in certain through-holes 26. The grid pattern of a row of the through holes 26 corresponds to the grid pattern of the transverse grooves of the plug body 4, so that by rotation of the plug body in the socket housing 20 the contact pins or contact wires 28 come to lie in the transverse grooves and make contact with the contact surfaces. The socket housing 20 comprises an insertion opening 22, which forms a passage for the plug. The passage has a polygonal shape, which corresponds to the polygonal shape of the cross-section of the plug body. In the region of this insertion opening 22 at least one stop piece is moulded on, which ensures an angular position of the longitudinal edges 18 of the plug 2 to the contact wires or pins 28 in the socket 3 during the insertion of the plug. In FIG. 7 a rectangular shape for the insertion opening is formed by means of four stop pieces 36.1, 36.2, 36.3, 36.4. The angular position of this polygonal shape is chosen such that when the plug body 4 is inserted into the socket housing 20, the longitudinal edges of the plug body with its contact surfaces do not come to lie opposite the through holes with the contact wires or pins of the socket housing 20.

Figure 6:
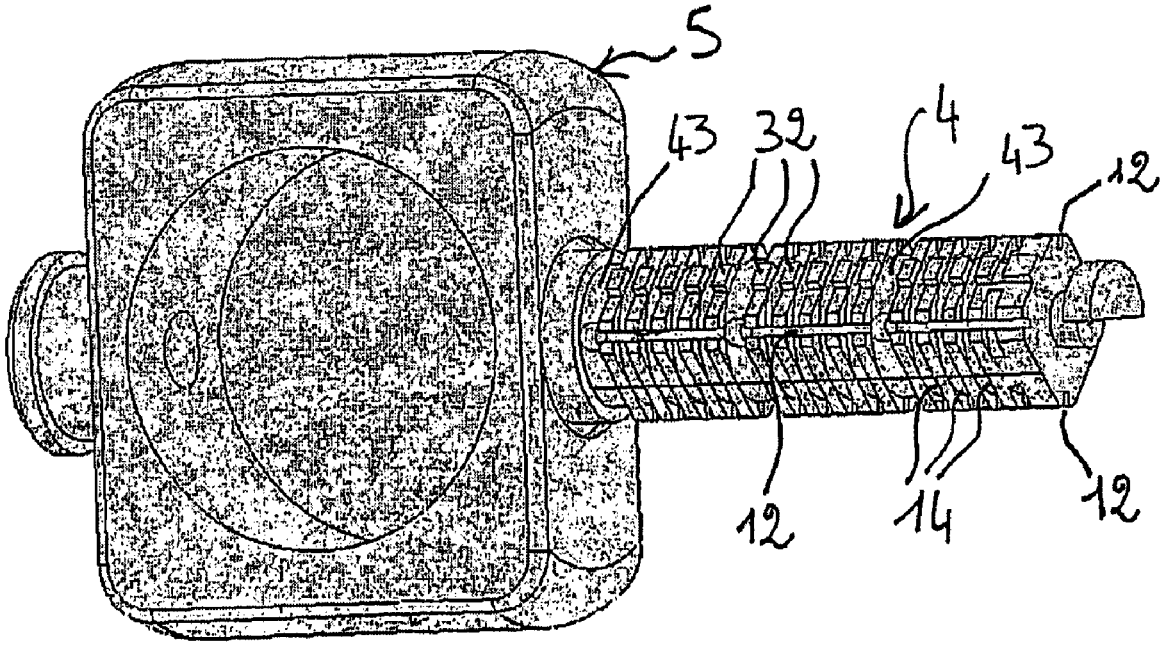
FIG. 6 a perspective view of the plug according to a third variant of the invention.

As is clear from FIG. 3, at the junction between the end of the plug body and the plug handle 5, the plug 2 comprises a circular channel 43, which has a smaller diameter than the gap between two opposite stop pieces 36.1, 36.3 or 36.2, 36.4 in the plug body. When the plug body 4 is inserted into the socket housing 20, the plug body 4 can only rotate once the circular channel has reached the insertion opening. FIG. 6 also shows a plug comprising multiple circular channels 43, which are distributed over the length of the plug body. Between two consecutive circular channels 43 a part of the longitudinal grooves with a predefined number of the transverse grooves is arranged. This embodiment increases the stability of the mechanical connection of plug and socket in the secured, rotated arrangement.

The plug body can also, as shown in FIGS. 2 and 6, comprise a cam 32 on a side surface of the plug body, between two of its longitudinal edges. This longitudinal cam 32 extends as far as the circular channel 43 and is interrupted in the region of the each of the transverse grooves 14. The insertion opening 22 of the socket housing 20, in particular one of the stops 36.4 of the insertion opening 22, has a corresponding receiving channel 34 for the cam 32. The cam 32 can be inserted with a positive-locking connection into the corresponding receiving channel 34. This longitudinal cam 32 and the corresponding receiving channel 34 allow the insertion of the plug body into the socket housing only when the plug bodies are in a certain position relative to the socket. It is thus possible to specify which longitudinal groove is to be assigned to which row of through holes and the contact wires or pins thereof. In addition, the longitudinal cam 32, with the receiving channel 34 and the stop pieces forming a polygonal shape for the insertion opening, forms a bayonet locking means, which effects the translatory locking of the plug in the socket 3 as soon as the non-conducting plug body 4 has been inserted into the socket housing 20 and rotated. Other types of bayonet locking means are conceivable while preserving the teaching of the invention.

It is of course possible to provide a cam instead of a receiving channel on a stop piece 36.4, and to provide in the plug body 4 instead of a cam 32, a corresponding receiving channel for the cam. It is also possible that this receiving channel is a longitudinal groove. The cam fits with a positive-locking connection into a receiving channel in the plug body 4.

The receiving channel 34 is in contact with a circular groove, in which the cam 32 is able to engage in an end position and the plug is thus securable in the socket body with a bayonet-type closure.

FIG. 6 shows another embodiment of the plug. Each transverse groove extends transversely to the longitudinal direction of the longitudinal grooves. While the external contour of the plug body 4 thus remains polygonal, the cross-sectional shape of the plug body in the region of the transverse grooves is circular.

Figure 8:
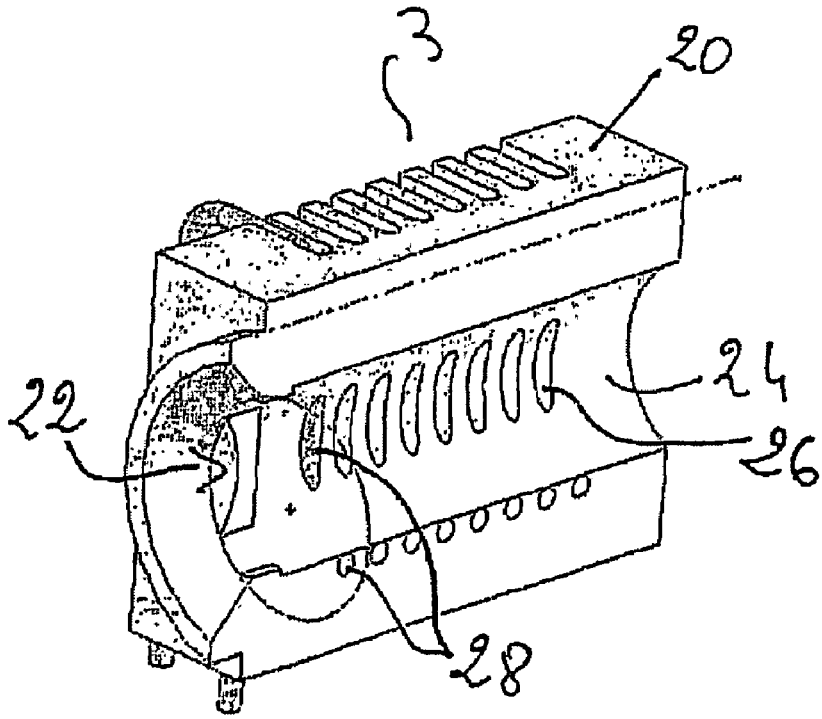
FIG. 8 an axial section through the socket according to FIG. 7.

From FIG. 8 it can be seen that the contact wires or pins 28 cross the inner chamber 24 of the socket housing 20 in such a way that the plug body 4 can be inserted in a pre-specified angular position, and the contact wires or pins 28 in the rotated position of the plug 2 come into touching contact with the conducting contact surfaces 8 of the circuit board 6. Advantageously all of the contact wires or pins 28 are brought out on a single side surface of the socket housing, so that the socket housing can be applied to a circuit board of a printed circuit. The socket housing 20 has a rectangular cross-section.

The circular form of the transverse grooves prevents the contact wires or pins from being damaged by the rotation of the plug body 4 in the socket 3.

LIST OF REFERENCE LABELS

1 Plug unit
2 Plug
3 Socket
4 Non-conducting plug body
41.1, . . . , 41.6 Feed-through channel
42 Cavity
43 Circular channel
5 Plug handle
51 Entry hole
52 Inner chamber
6 Circuit board
8 Conducting contact surfaces, printed
12 Longitudinal groove
13,1, 13.2 Lateral Longitudinal channels
14 Transverse grooves
16 Cross-sections of the non-conducting plug body
18 Longitudinal edges
20 Socket housing
22 Insertion opening
24 Inner chamber
26 Through holes
28 Contact wires or pins
32 Cam
34 Receiving channel for cam
36.1, 36.2,
36.3, 36.4 Stop piece

The invention claimed is:

1. A multi-pole plug unit comprising a plug with a non-conducting plug body and a socket with a socket housing comprising an insertion opening, which when combined form an electrical and a positive-locking connection, wherein the plug body has a polygonal cross-section, wherein in the region of at least one longitudinal edge there extends a longitudinal groove which is crossed by a plurality of transverse grooves in a pre-defined grid pattern, and that in the longitudinal groove a printed circuit board is inserted, which at certain points of the transverse grooves has contact surfaces, and that additionally the socket has contact wires or pins extending transversely to its longitudinal direction, which by rotation of the plug come to lie in the transverse grooves and thus come into touching contact with the contact surfaces and simultaneously effect a translatory locking of the plug in the socket.

2. The multi-pole plug unit according to claim 1, wherein the longitudinal groove is an open longitudinal groove, which is opened along at least one part of its length, and the printed circuit board is inserted in the open longitudinal groove and is held in place by being glued or clamped in.

3. The multi-pole plug unit according to claim 1, wherein the longitudinal groove is closed and of a tunnel-shaped construction and is arranged in the plug body in the longitudinal direction, wherein the longitudinal groove discharges into an opening at the end of the plug body, wherein the printed circuit board is introduced into the longitudinal groove and wherein the longitudinal groove crosses the transverse grooves.

4. The multi-pole plug unit according to claim 2, wherein the at least one longitudinal groove is expanded in the region of the groove base and the circuit board is held in this region with a positive-locking fit.

5. The multi-pole plug unit according to claim 1, wherein the plug body has a cavity extending in its longitudinal direction, which is joined via feed-through channels extending transversely to the longitudinal direction to the longitudinal grooves, wherein lead wires leading to the circuit board are arranged in the feed-through channels.

6. The multi-pole plug unit according to claim 1, wherein the plug body has a circular cross-section in the region of the transverse grooves.

7. The multi-pole plug unit according to claim 1, wherein the insertion opening defines a passage for the plug body with a polygonal shape corresponding to the cross-section of the plug body.

8. The multi-pole plug unit according to claim 7, wherein at least one stop piece is moulded on the socket housing in the region of the insertion opening, which during the insertion of the plug guarantees a predefined angular position of the plug body to the contact wires or pins of the socket.

9. The multi-pole plug unit according to claim 1, wherein a cam is moulded on a side surface of the polygonal cross-section plug body , which cam can be inserted in a corresponding receiving channel in the socket housing with a positive-locking connection.

10. The multi-pole plug unit according to claim 1, wherein a cam is applied in the socket housing, which projects into the insertion opening and fits into a longitudinal groove in the plug body with a positive-locking connection.

11. The multi-pole plug unit according to claim 9, wherein the receiving channel is connected to a circular groove, in which the cam is able to engage in an end position, whereby the plug is securable in the socket body with a bayonet-type closure.

12. The multi-pole plug unit according to claim 1, wherein the socket housing has a rectangular cross-section and all of the contact wires or pins are brought out on one side surface of the socket housing, so that the socket housing can be applied to a circuit board of a printed circuit.

* * * * *